US011446838B2

(12) United States Patent
Haseba et al.

(10) Patent No.: US 11,446,838 B2
(45) Date of Patent: Sep. 20, 2022

(54) TRIMMING DEVICE, POST-PROCESSING DEVICE, AND IMAGE FORMING APPARATUS WITH POST-PROCESSING DEVICE

(71) Applicant: FUJIFILM BUSINESS INNOVATION CORP., Tokyo (JP)

(72) Inventors: Shigehiko Haseba, Kanagawa (JP); Shiro Yamahashi, Kanagawa (JP); Nobutoshi Hamasaki, Kanagawa (JP); Kazutoshi Shima, Kanagawa (JP); Hiroaki Mogi, Kanagawa (JP); Shoya Kinoshita, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 164 days.

(21) Appl. No.: 16/983,274

(22) Filed: Aug. 3, 2020

(65) Prior Publication Data

US 2021/0291396 A1 Sep. 23, 2021

(30) Foreign Application Priority Data

Mar. 23, 2020 (JP) ..... JP2020-050970

(51) Int. Cl.
*G03G 15/00* (2006.01)
*B41J 11/66* (2006.01)
(Continued)

(52) U.S. Cl.
CPC ..... *B26D 7/015* (2013.01); *B26D 1/085* (2013.01); *B26D 7/0625* (2013.01); *B41J 11/66* (2013.01);
(Continued)

(58) Field of Classification Search
CPC combination set(s) only.
See application file for complete search history.

(56) References Cited

U.S. PATENT DOCUMENTS

2009/0221411 A1* 9/2009 Endo ..... B42B 5/00 493/407
2010/0232912 A1* 9/2010 Hata ..... B42C 1/12 234/128
2012/0152075 A1* 6/2012 Nakada ..... B26D 7/015 83/109

FOREIGN PATENT DOCUMENTS

JP 2007-326705 A 12/2007
JP 2010018396 A * 1/2010
(Continued)

*Primary Examiner* — Jennifer Bahls
(74) *Attorney, Agent, or Firm* — Oliff PLC

(57) ABSTRACT

A trimming device includes: a moving unit including a transport unit that transports a booklet which includes one or more sheets and which is folded in half at a center portion of the booklet, with a folded portion of the booklet at a front, a correction unit that corrects a posture of the booklet in response to a leading end of the booklet transported by the transport unit abutting against the correction unit, the correction unit being capable of advancing to an abutting position on a path of the booklet and retracting from the path, and an upper guide unit that extends at least between the transport unit and the correction unit, the upper guide unit that guides an upper surface of the booklet, the moving unit being movable in a transport direction between (i) a predetermined upstream position and (ii) a downstream position downstream of the upstream position in the transport direction; a lower guide unit that guides a lower surface of the booklet transported by the transport unit; and a cutting unit that cuts a downstream fore edge portion of the booklet in the transport direction, the cutting unit being capable of advancing to the path of the booklet and retracting from the path of the booklet. The upper guide unit is configured such that a gap between the upper guide unit and the lower guide unit widens in accordance with a thickness of the booklet to allow the booklet to pass through the gap.

18 Claims, 9 Drawing Sheets

(51) Int. Cl.
*B26D 7/01* (2006.01)
*B26D 1/08* (2006.01)
*B26D 7/06* (2006.01)

(52) U.S. Cl.
CPC ..... *G03G 15/6573* (2013.01); *G03G 15/6582* (2013.01); *G03G 2215/00814* (2013.01)

(56) References Cited

FOREIGN PATENT DOCUMENTS

| | | | | | |
|---|---|---|---|---|---|
| JP | 2010195582 | A | * | 9/2010 | |
| JP | 2010260719 | A | * | 11/2010 | ..... B26D 7/015 |
| JP | 2013119144 | A | * | 6/2013 | |

* cited by examiner

TRIMMING DEVICE, POST-PROCESSING DEVICE, AND IMAGE FORMING APPARATUS WITH POST-PROCESSING DEVICE

CROSS-REFERENCE TO RELATED APPLICATIONS

This application is based on and claims priority under 35 USC 119 from Japanese Patent Application No. 2020-050970 filed Mar. 23, 2020.

BACKGROUND

1. Technical Field

The present disclosure relates to a trimming device, a post-processing device, and an image forming apparatus with the post-processing device.

2. Related Art

There are trimming devices that trim a fore edge of a booklet obtained by, for example, stacking plural sheets on which images are formed and folding the sheets in half. Such trimming devices need to accurately trim the booklet to a predetermined dimension such that the dimension of the booklet after trimming the fore edges does not vary for each booklet. Therefore, it is necessary to correct an inclination of the transported booklet and then trim the booklet.

Here, JP-A-2007-326705 discloses a device that transports a booklet by a roller to abut the booklet against a stopper, thereby correcting a posture of the booklet.

SUMMARY

The trimming device is required to be versatile such that the trimming device can trim booklets having a wide range of thickness, for example, from a thin booklet including one or two sheets to a thick booklet including ten or more sheets. Therefore, the trimming device needs to have a structure such that the trimming device can accurately trim a booklet of any thickness among the booklets having a wide range of thickness to a predetermined dimension.

Aspects of non-limiting embodiments of the present disclosure relate to providing (i) a trimming device with improved versatility regarding a thickness of a booklet as compared with a device without a structure that prevents curl of particularly a thin booklet when a folded portion is brought into contact therewith, (ii) a post-processing device including the trimming device, and (iii) an image forming apparatus with the post-processing device.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a trimming device including: a moving unit including a transport unit that transports a booklet which includes one or more sheets and which is folded in half at a center portion of the booklet, with a folded portion of the booklet at a front, a correction unit that corrects a posture of the booklet in response to a leading end of the booklet transported by the transport unit abutting against the correction unit, the correction unit being capable of advancing to an abutting position on a path of the booklet and retracting from the path, and an upper guide unit that extends at least between the transport unit and the correction unit, the upper guide unit that guides an upper surface of the booklet, the moving unit being movable in a transport direction between (i) a predetermined upstream position and (ii) a downstream position downstream of the upstream position in the transport direction; a lower guide unit that guides a lower surface of the booklet transported by the transport unit; and a cutting unit that cuts a downstream fore edge portion of the booklet in the transport direction, the cutting unit being capable of advancing to the path of the booklet and retracting from the path of the booklet. The upper guide unit is configured such that a gap between the upper guide unit and the lower guide unit widens in accordance with a thickness of the booklet to allow the booklet to pass through the gap.

BRIEF DESCRIPTION OF THE DRAWINGS

Exemplary embodiment(s) of the present disclosure will be described in detail based on the following figures, wherein.

DETAILED DESCRIPTION

Hereinafter, an exemplary embodiment of the present disclosure will be described.

Figure 1:
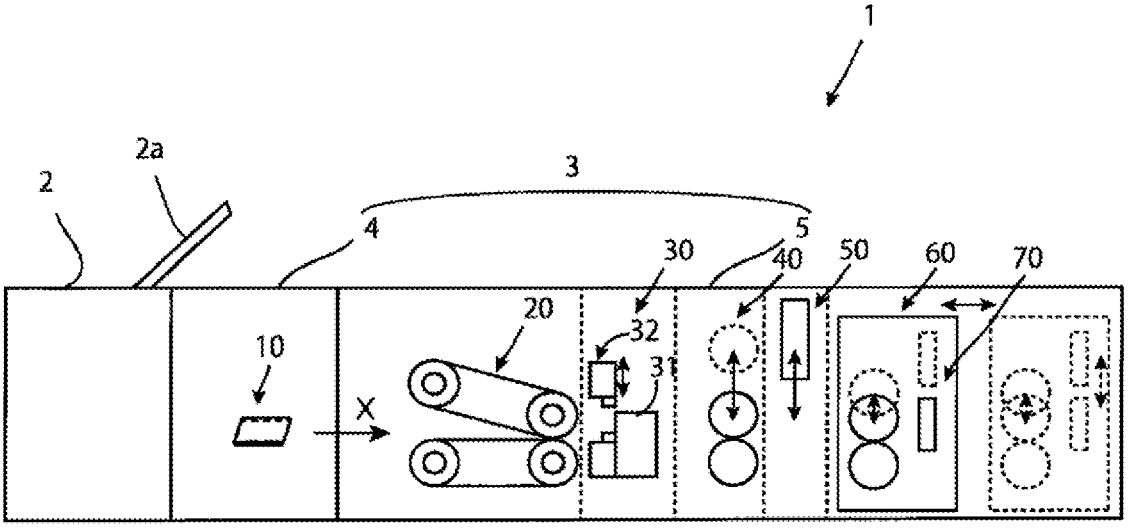
FIG. 1 is a diagram illustrating an outline of an image forming apparatus with a post-processing device according to an exemplary embodiment of the present disclosure.

FIG. 1 is a diagram illustrating an outline of an image forming apparatus with a post-processing device according to the exemplary embodiment of the present disclosure.

An image forming apparatus 1 with a post-processing device illustrated in FIG. 1 includes an image forming device 2 and a post-processing device 3. Further, the post-processing device 3 includes a booklet manufacturing device 4 and a trimming device 5. Here, the present exemplary embodiment is characterized in the trimming device 5, and the image forming device 2 and the booklet manufacturing device 4 may be general-purpose devices known in the related art, and are illustrated here as simple rectangles. The image forming device 2 may be an electrophotographic image forming device or an inkjet image forming device. An image generating method of the image forming device 2 may be any method.

When no post-processing is necessary, a sheet on which an image is formed by the image forming device 2 is discharged onto a discharge tray 2*a* of the image forming device 2. On the other hand, a sheet requiring the post-processing is not discharged to the discharge tray 2*a* but is transported toward the post-processing device 3. The booklet manufacturing device 4 that constitutes the post-processing device 3 folds the transported sheet in half at a center portion thereof to manufacture a booklet.

Figure 2:
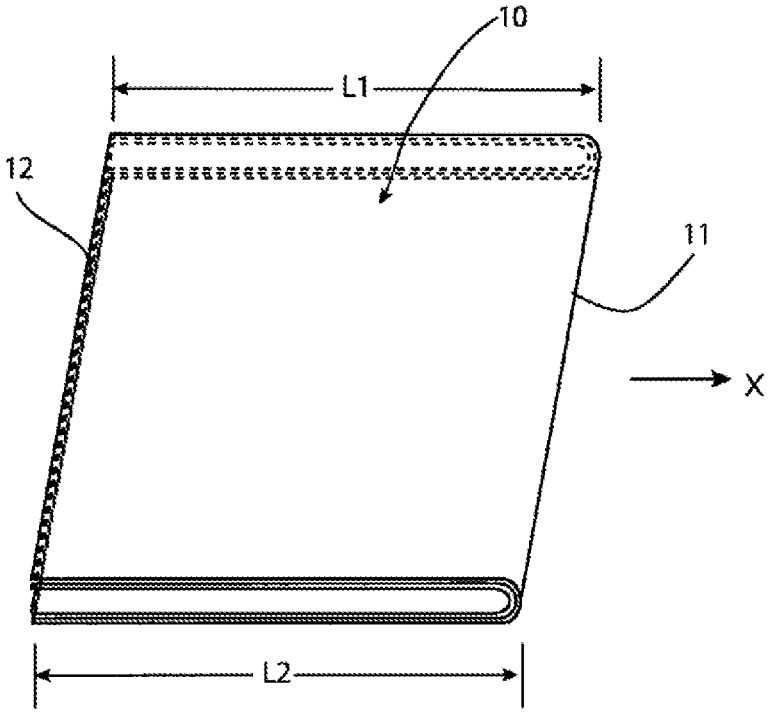
FIG. 2 is a schematic diagram of a booklet manufactured by a booklet manufacturing device.

FIG. 2 is a schematic diagram of the booklet manufactured by the booklet manufacturing device 4.

In the booklet manufacturing device 4, one or plural sheets on which the images are formed by the image forming device 2 are stacked and folded at the center thereof to manufacture a booklet 10 as illustrated. The manufactured booklet 10 is transported in a direction of an arrow X with a folded portion 11 at a front and a fore edge portion 12 at a rear, and passed to the trimming device 5 illustrated in FIG. 1.

In the trimming device 5, the fore edge portion 12 side is trimmed such that the booklet has a predetermined dimension from the folded portion 11 to the fore edge portion 12. The booklets 10 are fed to the trimming device 5 one by one and are trimmed one by one. At this time, when the booklet 10 is trimmed in a skewed state, that is, in an inclined state, the booklet 10 has different dimensions L1 and L2 on both sides. When the booklets 10 that are sequentially manufactured and sequentially fed to the trimming device 5 are somewhat skewed, the dimensions of the booklets that should have been trimmed becomes uneven, resulting in a reduction in quality of the trimming device 5. Therefore, the trimming device 5 of the present exemplary embodiment includes a skew correction gate 70. The trimming device 5 abuts the folded portion 11 of the booklet 10 against the skew correction gate 70 so as to correct the skew of the booklet 10. Details thereof will be described later.

Here, the booklet manufacturing device 4 manufactures booklets having a wide range of thickness from a thin booklet including one or two sheets to a thick booklet including ten or more sheets. Therefore, the trimming device 5 needs to have an ability to correctly correct the skew regardless of the thickness of the booklet. Particularly, when abutting the thin booklet against the skew correction gate 70, the trimming device 5 needs to correctly correct the skew while preventing the booklet from lifting and swelling due to an abutting force. On the other hand, when the booklet is thick, in order to correctly correct the skew, the trimming device 5 needs to abut the thick booklet against the skew correction gate 70 with a strong force of a certain degree.

Hereinafter, an outline of the trimming device 5 will be described with reference to FIG. 1. Subsequently, characteristic portions of the trimming device 5 will be described in detail.

The booklet 10 fed to the trimming device 5 is further transported by a belt transport unit 20 and reaches a shaping unit 30. In the shaping unit 30, the folded portion 11 of the booklet 10 is pushed against a square roller 31 to correct the skew of the booklet 10, and then is sandwiched in a thickness direction by a clamper 32 so as to shape (form) the folding portion 11 to have a rectangular shape in cross section. It is noted that the shaping unit 30 operates only when it is necessary to make the folded portion 11 rectangular. When it is not necessary to make the folded portion 11 rectangular, the booklet 10 simply passes through the shaping unit 30. In the shaping unit 30, when the folded portion 11 is shaped (formed) in the rectangular shape, the clamper 32 opens and the square roller 31 retracts so as to allow the booklet 10 to pass.

A square discharge roller 40 is provided immediately after the shaping unit 30. The booklet 10 that passes through the shaping unit 30 is further transported by the square discharge roller 40.

A cutter 50 is disposed immediately after the square discharge roller 40. The cutter 50 retracts upward except when the fore edge portion 12 of the booklet 10 is to be trimmed.

A moving unit 60 is disposed after the cutter 50. The moving unit 60 includes roller pairs each including upper and lower rollers and the skew correction gate 70 disposed immediately after the roller pairs. The rollers of the roller pairs rotate while sandwiching the booklet 10 transported by the square discharge roller 40 so as to further transport the booklet 10 and abut the booklet 10 against the skew correction gate 70. The moving unit 60 can move from an upstream position illustrated by solid lines in FIG. 1 to a downstream position illustrated by broken lines in FIG. 1 while sandwiching the booklet 10 by the roller pairs. The moving unit 60 corresponds to an example of a moving unit according to the present disclosure.

When receiving the booklet 10 transported by the square discharge roller 40, the moving unit 60 is at the upstream position illustrated by the solid lines. At this time, the skew correction gate 70 descends to a position where a path of the booklet 10 is closed. Upon receipt of the booklet 10, the moving unit 60 rotates the rollers of the roller pairs and pushes the folded portion 11 of the booklet 10 against the skew correction gate 70. Accordingly, the skew of the booklet 10 is corrected. The skew correction gate 70 corresponds to an example of a correction unit according to the present disclosure. When the shaping unit 30 is not operated, the skew occurs during a period where the booklet 10 received from the booklet manufacturing device 4 reaches the skew correction gate 70. Even when the shaping unit 30 is operated, the skew may occur after the booklet 10 passes through the shaping unit 30.

When the skew of the booklet 10 is corrected by abutting the booklet 10 against on the skew correction gate 70, the moving unit 60 stops the rotation of the rollers of the roller pairs, and moves toward the downstream position illustrated by the broken lines while the booklet 10 is still sandwiched by the rollers of the roller pairs. It is noted that the moving unit 60 may not move up to the downstream position. The moving unit 60 moves to a position where a distance between the folded portion 11 of the booklet 10 and the cutter 50 is a predetermined dimension of the booklet after being trimmed and then stops. Then, the cutter 50 descends and trims the fore edge portion of the booklet 10. The cutter 50 corresponds to an example of a cutting unit according to the present disclosure. Thereafter, when the moving unit 60 has not moved to the downstream position, the moving unit 60 moves to the downstream position and the skew correction gate 70 retracts upward. Then, the rollers of the roller pairs of the moving unit 60 are rotated again, and the trimmed booklet 10 is fed to the following stage.

Figure 3A:
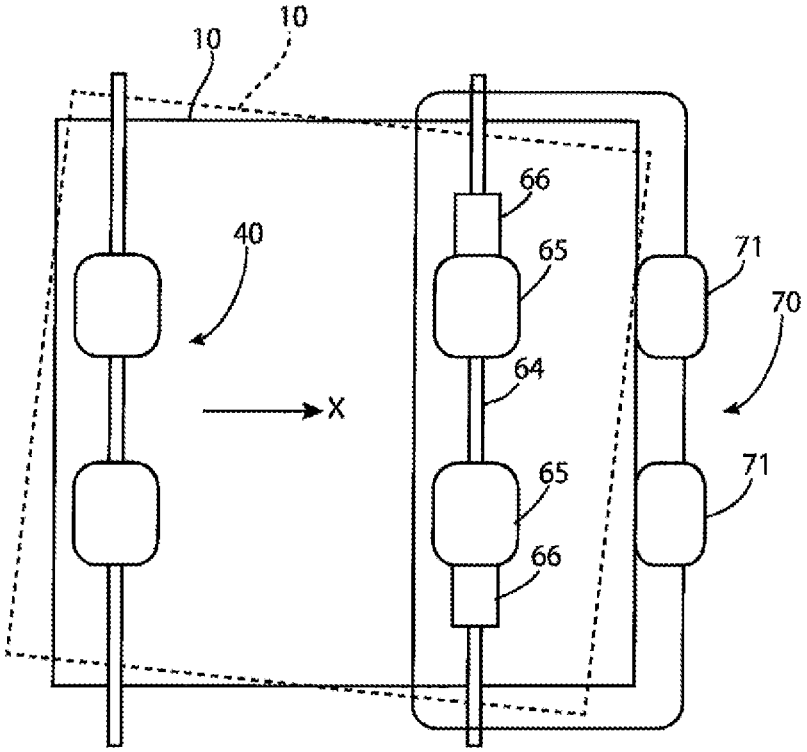
FIGS. 3A and 3B are schematic diagrams illustrating a structure of a part of a trimming device that corrects a skew of the booklet by abutting the booklet against a skew correction gate.
Figure 3B:
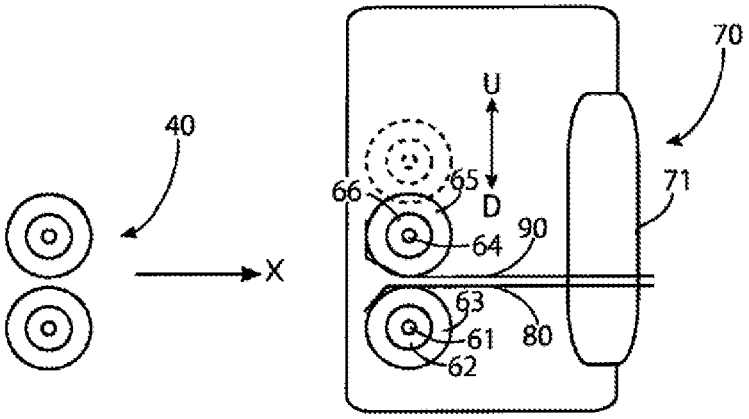

FIGS. 3A and 3B are schematic diagrams illustrating a structure of a part of the trimming device 5 that corrects the skew of the booklet 10 by abutting the booklet 10 against the skew correction gate 70. Here, FIG. 3A is a schematic plan view, and FIG. 3B is a schematic side view.

The booklet 10 fed by the square discharge roller 40 is sandwiched between the rollers of the roller pairs of the moving unit 60 and is further transported. The roller pairs of the moving unit 60 include two lower rollers 62 and two upper rollers 65. The two lower rollers 62 are supported at positions on a rotation shaft 61 which are separated from each other in a width direction. The rotation shaft 61 extends in the width direction intersecting a transport direction of the booklet 10. The two upper rollers 65 are supported at positions on a rotation shaft 64 which are separated from each other in the width direction. The rotation shaft 64 also extends in the width direction.

A torque limiter 63 is attached to each of the two lower rollers 62. A torque limiter 66 is attached to each of the two upper rollers 65. The two lower rollers 62 rotate with rotation of the rotation shaft 61. When the two lower rollers 62 reach a torque limit of the torque limiters 63, the rotation of the lower rollers 62 stops even if the rotation shaft 61 rotates. The rotation stop caused by an action of the torque limiters 63 independently acts on the two lower rollers 62.

Similarly, the two upper rollers 65 rotate with rotation of the rotation shaft 64. When the two upper rollers 65 reach a torque limit of the torque limiter 66, the rotation of the upper rollers 65 stops even if the rotation shaft 64 rotates. The rotation stop caused by the torque limiter 66 independently acts on the two upper rollers 65. The lower rollers 62 and the upper rollers 65 are examples of a transport roller according to the present disclosure. The lower rollers 62 and the upper rollers 65 respectively correspond to examples of a lower transport unit and an upper transport unit according to the present disclosure.

The skew correction gate 70 includes two abutting portions 71 at positions separated from each other in the width direction. The booklet 10 is abutted against the abutting portions 71.

The booklet 10 fed in the direction of the arrow X by the square discharge roller 40 may be skewed as illustrated by a broken line in FIG. 3A. In this case, the booklet 10 first abuts against one of the two abutting portions 71. Then, torque of one of the lower rollers 62 and one of the upper rollers 65 which are driven to transport the abutting side of the booklet 10 increase, and the rotation of the one of the lower rollers 62 and the rotation of the one of the lower rollers 65 are stopped. It is noted that the other of the lower rollers 62 and the other of the upper rollers 65 are still driven to transport the booklet 10, and the booklet 10 is also abutted against the other abutting portion 71. Accordingly, the skew of the booklet 10 is corrected, and the booklet 10 has a correct posture as illustrated by a solid line in FIG. 3A.

As illustrated in FIG. 3B, the upper rollers 65, together with the rotation shaft 64 and the torque limiter 66, move up and down in a direction of an arrow U-D between a position illustrated by a solid line and a position illustrated by a broken line in FIG. 3B. When the thick booklet 10 is received between the lower rollers 62 and the upper rollers 65, the upper rollers 65 move up to the position illustrated by the broken line in advance and, after a leading end of the booklet 10 is received, the upper rollers 65 descend to a position corresponding to the thickness of the booklet 10. It is noted that when the thin booklet 10 is received between the lower rollers 62 and the upper rollers 65, the upper rollers 65 do not move up and retain in the descending position.

The booklet manufacturing device 4 at the preceding stage waits until the number of sheets fed one by one from the image forming device 2 and stacked reaches the number of sheets constituting the booklet 10, and then folds the stacked sheets. Therefore, when the thick booklet 10 is manufactured, there is a time interval from an end of the manufacture of one booklet to a start of the manufacture of the next booklet. On the other hand, in a case of the thin booklet 10, the time interval is short, and moving the upper roller 65 up and down will not be in time. As a result, the booklet manufacturing in the booklet manufacturing device 4 will be kept waiting, resulting in a decrease in productivity. Furthermore, in the case of the thin booklet 10, even if a space between the upper rollers 65 that is kept descended and the lower rollers 62 is narrow, the thin booklet 10 can be received.

As illustrated in FIG. 3B, a lower chute 80 and an upper chute 90 are provided. An upstream portion of the upper chute 90 moves up and down as the upper roller 65 moves up and down. A downstream portion of the upper chute 90 moves up and down as the skew correction gate 70 moves up and down. A gap between the lower chute 80 and the upper chute 90 is widened in accordance with the thickness of the booklet 10, and the lower chute 80 and the upper chute 90 guide a lower surface and an upper surface of the booklet 10 passing through the gap. Particularly, when the lower chute 80 and the upper chute 90 guide the thin booklet 10, the gap between the lower chute 80 and the upper chute 90 is reduced to, for example, about 1 mm. Accordingly, the lifting and the swelling of the booklet 10 when pushed against the skew correction gate 70 are prevented. The lower chute 80 and the upper chute 90 correspond to examples of a lower guide unit and an upper guide unit, respectively, according to the present disclosure. A structure of the upper chute 90 will be described later.

Here, the roller pairs which constitute the moving unit 60 and the abutting portions 71 of the skew correction gate 70 respectively correspond to examples of a transport unit and an abutting portion according to the present disclosure.

Figure 4:
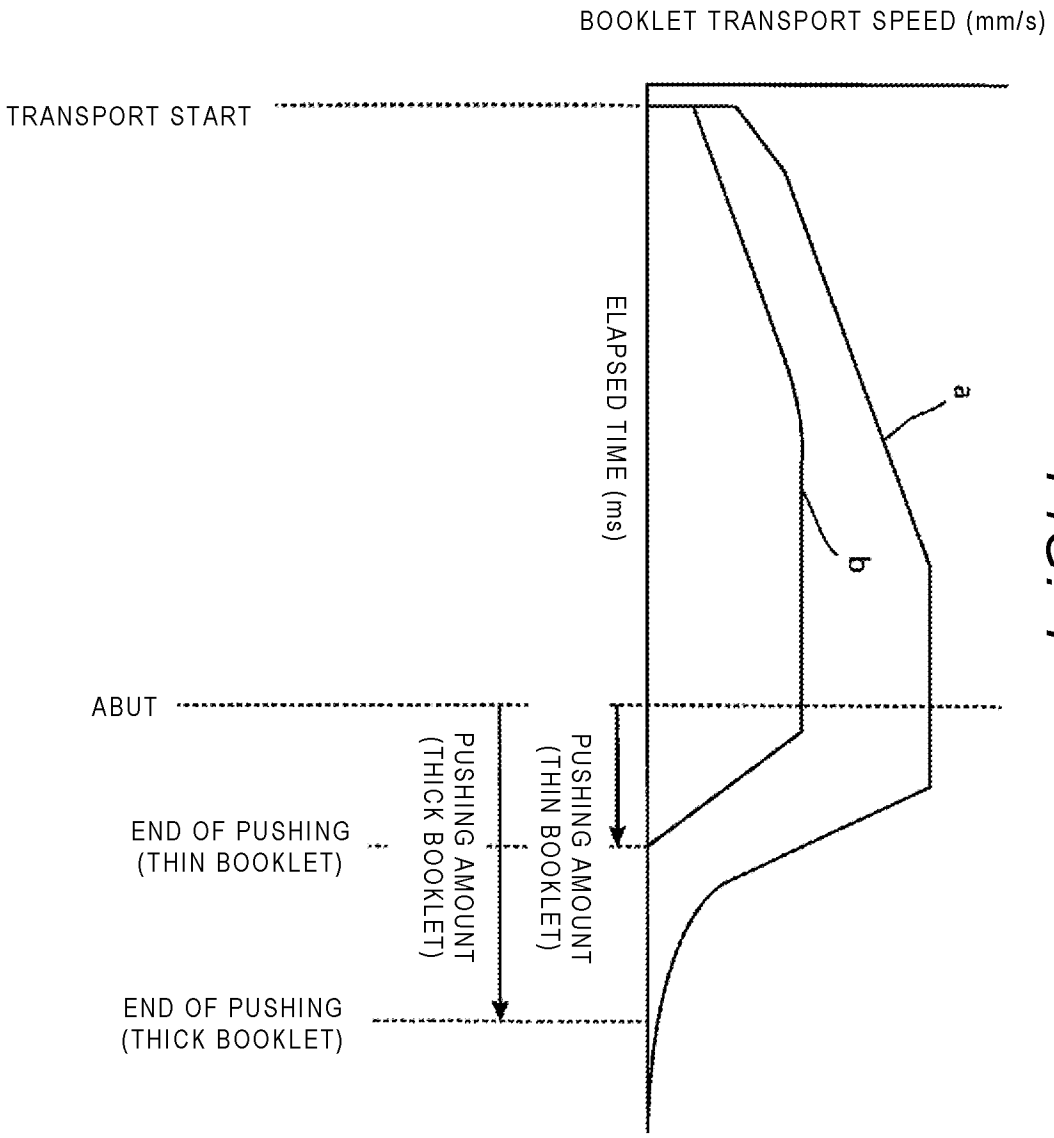
FIG. 4 is a diagram illustrating a temporal change in a transport speed of the booklet caused by roller pairs provided in a moving unit.

FIG. 4 is a diagram illustrating a temporal change in a transport speed of the booklet 10 transported by the roller pairs provided in the moving unit. A horizontal axis of FIG. 4 is elapsed time (ms), and a vertical axis of FIG. 4 is the transport speed (mm/s). Here, for simplification, two types of temporal changes in the transport speed are illustrated for a typical thin booklet and a typical thick booklet. The transport speed may be changed in more steps.

In FIG. 4, a graph "a" represents a transport speed change for the thick booklet, and a graph "b" represents a transport speed change for the thin booklet.

As can be seen from FIG. 4, the thick booklet and the thin booklet are common in that the transport speed is increased until the booklet moves and abuts against the skew correction gate 70, and after the abutment, the booklet is pushed against the abutting portion 71 of the skew correction gate 70 for a time required for the skew correction while the transport speed is reduced.

Here, compared with the thin booklet, the thick booklet abuts against the skew correction gate 70 at a higher speed and a pushing amount after the booklet reaches the skew correction gate 70 is larger. Accordingly, the skew can be reliably corrected even for the thick booklet.

The thin booklet has a smaller weight than that of the thick booklet. Therefore, the skew can be corrected with a relatively small force. On the other hand, in the case of the thin booklet, when the thin booklet is pushed against the skew correction gate 70 at a high speed or is pushed strongly, there is a possibility that damage such as deformation of the folded portion of the booklet or generation of wrinkles in the booklet may occur. Therefore, an abutting speed at which the thin booklet abuts against the skew correction gate 70 is lower than that of the thick booklet, and the pushing amount after the thin booklet reaches the skew correction gate 70 is smaller than that for the thick booklet.

In the present exemplary embodiment, in this way, no matter the booklet is thin or thick, the reliable skew correction is performed while preventing the damage to the booklet.

Next, an arrangement position of the skew correction gate in the width direction will be discussed.

Figure 5A:
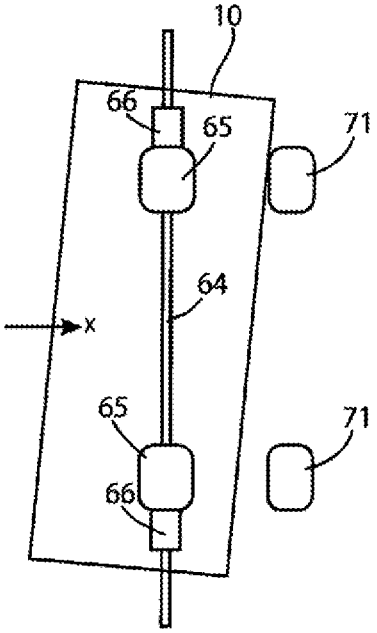
FIGS. 5A to 5C are diagrams illustrating arrangement positions of abutting portions of the skew correction gate in a width direction.
Figure 5B:
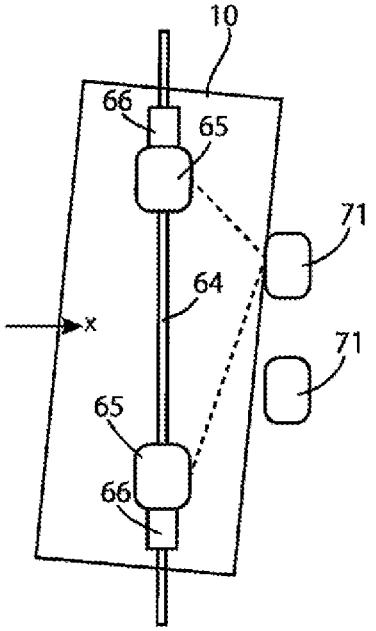
Figure 5C:
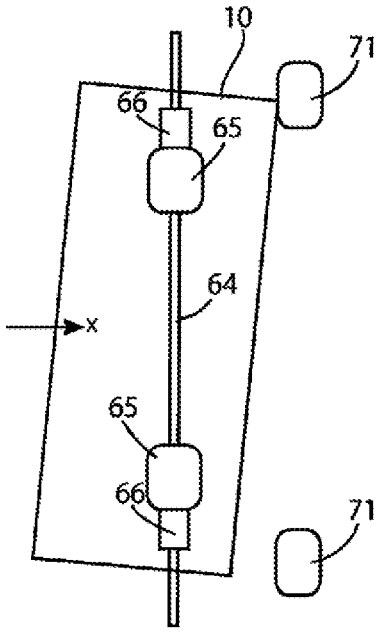

FIGS. 5A to 5C are diagrams illustrating arrangement positions of the abutting portions 71 of the skew correction gate 70 in the width direction. Here, FIG. 5A illustrates the arrangement position of the present exemplary embodiment. FIGS. 5B and 5C illustrate arrangement positions of comparative examples that are compared with the present exemplary embodiment.

As described with reference to FIG. 3, the abutting portions 71 of the skew correction gate 70 are provided at the two positions separated from each other in the width direction in the present exemplary embodiment. As also described above with reference to FIG. 3, in the present exemplary embodiment, roller pairs each including the lower roller 62 and the upper roller 65 are also disposed at the two positions separated from each other in the width direction.

Here, in the present exemplary embodiment illustrated in FIG. 5A, when viewed from the transport direction of the booklet 10 illustrated by the arrow X, each abutting portion 71 of the skew correction gate 70 and a respective one of the roller pairs at least partially overlap each other. Accordingly, in the present exemplary embodiment, the reliable skew correction is implemented while preventing the damage to the sheets.

On the other hand, in the comparative example illustrated in FIG. 5B, the abutting portions 71 of the skew correction gate 70 are disposed at positions closer to a center in the width direction than the roller pairs. In this case, after the folded portion 11 of the booklet 10 abuts against one of the two abutting portions 71, a force acts such that the rollers of the two roller pairs rotate the booklet 10 in opposite directions, and a rotational force for the skew correction may be hindered.

In the comparative example illustrated in FIG. 5C, the abutting portions 71 of the skew correction gate 70 are disposed outside the roller pairs in the width direction. In this case, the skew itself is easily corrected because the two abutting portions 71 are located at positions greatly separated from each other. However, a corner portion in the width direction of the folded portion 11 of the booklet 19 may come into contact with the skew correction gate 70, and the sheets may be deformed or damaged.

Therefore, in the present exemplary embodiment, the abutting portions 71 are disposed at the positions overlapping the roller pairs in the width direction.

Next, a structure of the moving unit 60 will be described.

Figure 6:
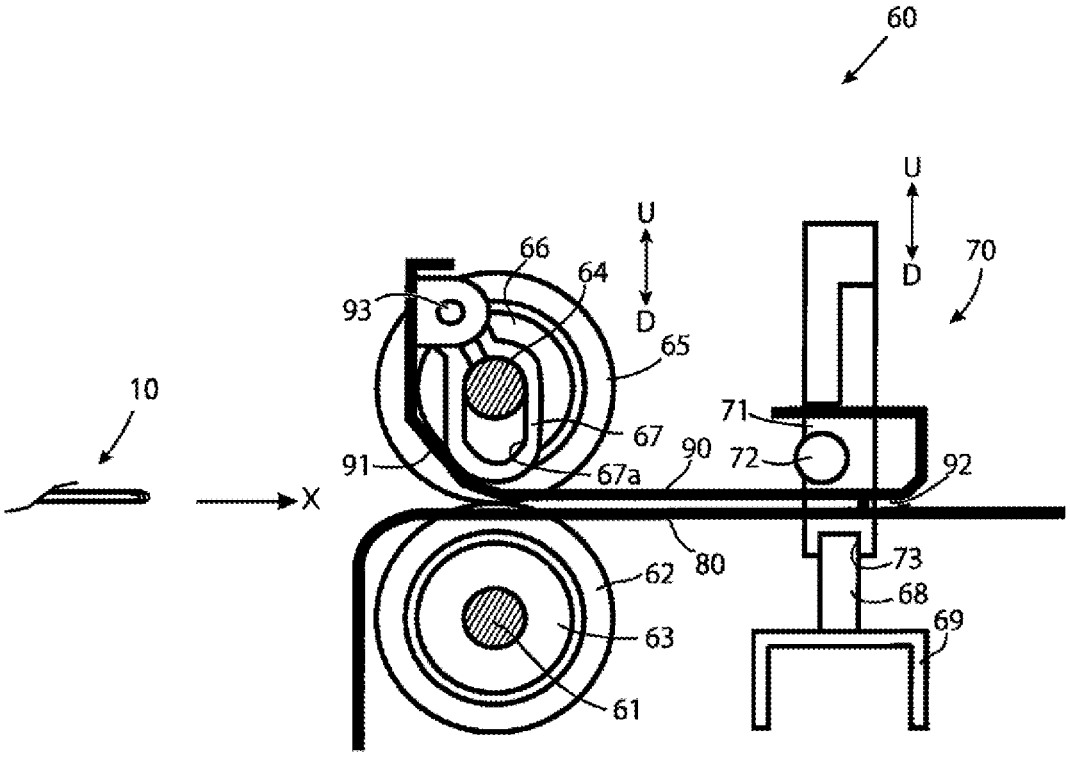
FIG. 6 is a side view illustrating the moving unit.

FIG. 6 is a side view illustrating the moving unit 60.

Figure 7:
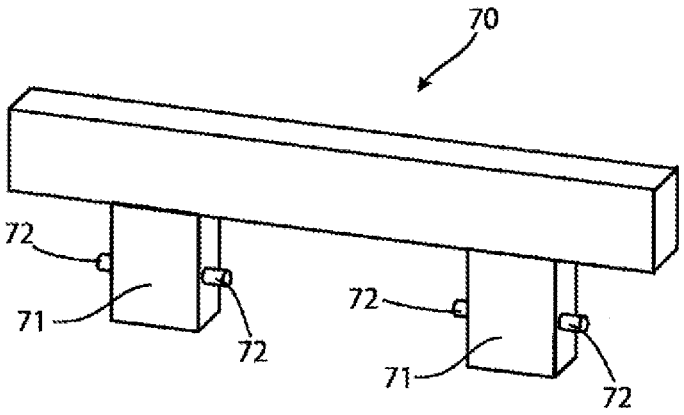
FIG. 7 is a perspective view of the skew correction gate that constitutes the moving unit.

FIG. 7 is a perspective view of the skew correction gate 70 that constitutes the moving unit 60.

Figure 8:
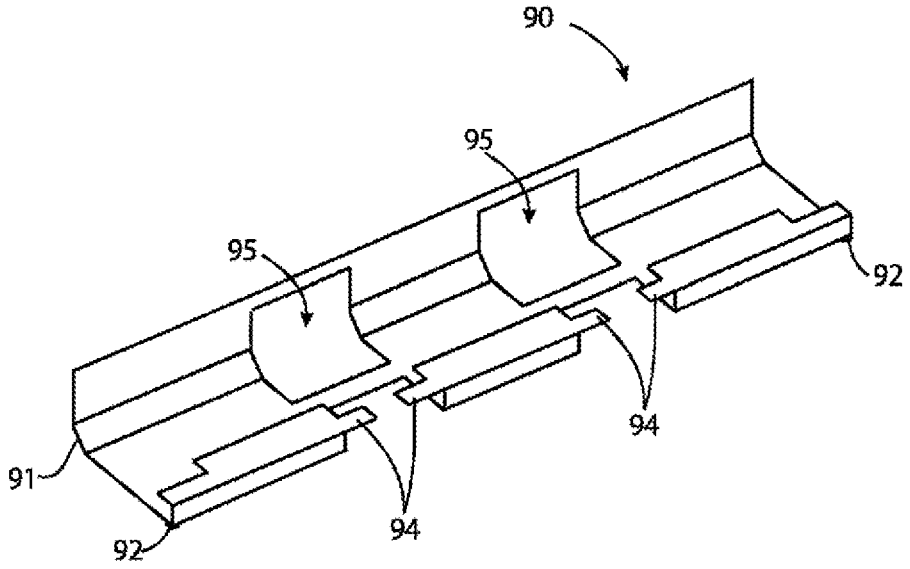
FIG. 8 is a perspective view of an upper chute that constitutes the moving unit.

FIG. 8 is a perspective view of the upper chute 90 that constitutes the moving unit 60.

The lower chute 80 is fixed to a body frame (not illustrated) and extends substantially horizontally. The rotation shaft 61 of the lower rollers 62 is rotatably supported by a frame 69 of the moving unit 60.

The upper roller 65 can move up and down in the direction of the arrow U-D. The rotation shaft 64 of the upper roller 65 is inserted into an elongating slot 67*a* of a bearing 67 and rotatably supported by the bearing 67. The elongating slot 67 elongates vertically. The upstream portion of the upper chute 90, that is, a portion near the upper roller 65 is rotatably supported by the bearing 67. When the upper roller 65 is located at a lower position illustrated in FIG. 6, the upper roller 65 comes into contact with the lower roller 62 by a weight of the upper roller 65. At this time, a gap of about 1 mm is formed between the upper chute 90 and the lower chute 80. A guiding inclined surface 91 is formed at the upstream portion of the upper chute 90. The guiding inclined surface 91 guides the booklet 10, which is transported in the direction of the arrow X, between the upper chute 90 and the lower chute 80. The upstream portion may have an arc shape instead of the inclined surface 91.

Positioning bosses 92 are provided at the downstream portion of the upper chute 90, that is, at a portion near the skew correction gate 70. The positioning bosses 92 are disposed on both sides in the width direction. The positioning bosses 92 protrude downward. The positioning boss 92 abuts against the lower chute 80, so that the gap of about 1 mm is formed between the downstream portion of the upper chute 90 and the lower chute 80. The positioning boss 92 corresponds to an example of a member that defines a minimum interval between the lower guide unit and the upper guide unit according to the present disclosure. The lower chute 80 may be provided with bosses protruding upward, instead of the positioning bosses 92.

The upper chute 90 is rotatably supported by the bearing 67. The downstream portion of the upper chute 90, that is, the portion near the skew correction gate 70 is lifted by the booklet 10 regardless of the skew correction gate 70 with a supported rotation shaft 93 as a center of rotation. This point will be described later.

Here, similar to the upper roller 65, the skew correction gate 70 can also move up and down in the direction of the arrow U-D. As illustrated in FIG. 7, each of the two abutting portions 71 of the skew correction gate 70 is provided with locking arms 72 protruding laterally. Meanwhile, as illustrated in FIG. 8, the upper chute 90 is provided with protrusions 94. These protrusions 94 are located directly above the locking arms 72. When the skew correction gate 70 is lifted in the direction of the arrow U, the downstream portion of the upper chute 90, that is, the portion of the upper chute 90 near the skew correction gate 70 is also lifted together. When the skew correction gate 70 is located at a lower position, a positioning pin 68 fixed to the frame 69 of the moving unit 60 is inserted into a positioning hole 73 formed in a lower surface of the skew correction gate 70, and the skew correction gate 70 is positioned.

Operation when the booklet 10 is transported in the direction of the arrow X will be described. Here, first, it is assumed that the thin booklet 10 is transported. Information about the thickness of the booklet 10, that is, the number of stacked sheets in the transported booklet 10 is received from the booklet manufacturing device 4 in advance. When it is found that the thin booklet is transported, the upper roller 65 descends in the direction of the arrow D and waits for the booklet 10 while being in contact with the lower roller 62 as illustrated in FIG. 6. At this time, the gap of about 1 mm is formed between the upper chute 90 and the lower chute 80.

When the booklet 10 tries to enter the gap between the upper chute 90 and the lower chute 80, if the gap is deviated in an upper-lower direction with respect to the booklet 10, or the booklet 10 is thin but cannot enter the gap of 1 mm, the upstream portion of the upper chute 90 is lifted. The upper chute 90 is supported by the bearing 67. As illustrated in FIG. 8, two openings 95 are formed in the upper chute 90. The two upper rollers 65 enter these openings 95, so that the upper rollers 65 avoid interfering with the upper chute 90. Therefore, the upper chute 90 is lifted independently of the upper roller 65 by a vertical dimension of the elongating slot 67*a* of the bearing 67. Also for the downstream portion of the upper chute 90, when the booklet 10 cannot enter the gap, the upper chute 90 is lifted by an amount corresponding to the thickness of the booklet 10. The folded portion 11 of the booklet 10 is abutted against the abutting portions 71 of the skew correction gate 70, and the skew correction as described above is performed. Operation of the moving unit 60 after the skew correction will be described after operation up to the skew correction for the thick booklet is described.

Figure 9:
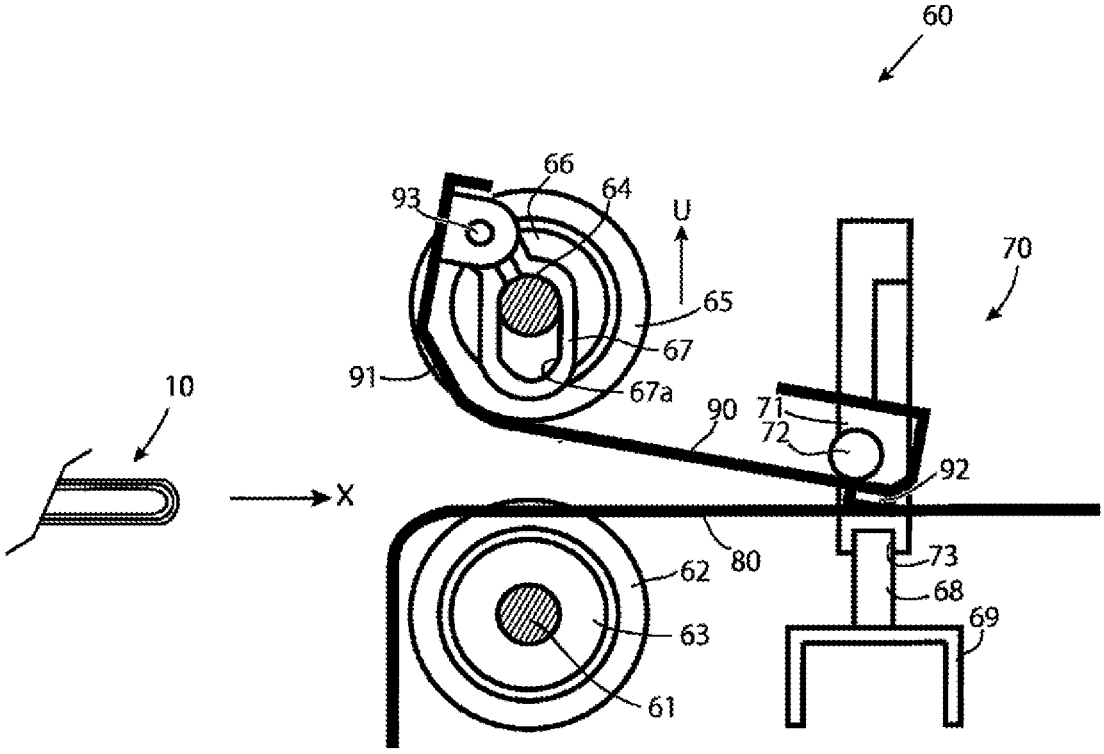
FIG. 9 is a side view of the moving unit in a state in which upper rollers are lifted.

FIG. 9 is a side view of the moving unit 60 in a state in which the upper rollers 65 are lifted.

As illustrated in FIG. 9, when the thick booklet 10 is transported, the upper rollers 65 wait for the transport of the booklet 10 in a state of being moved up in the direction of the arrow U.

Figure 10:
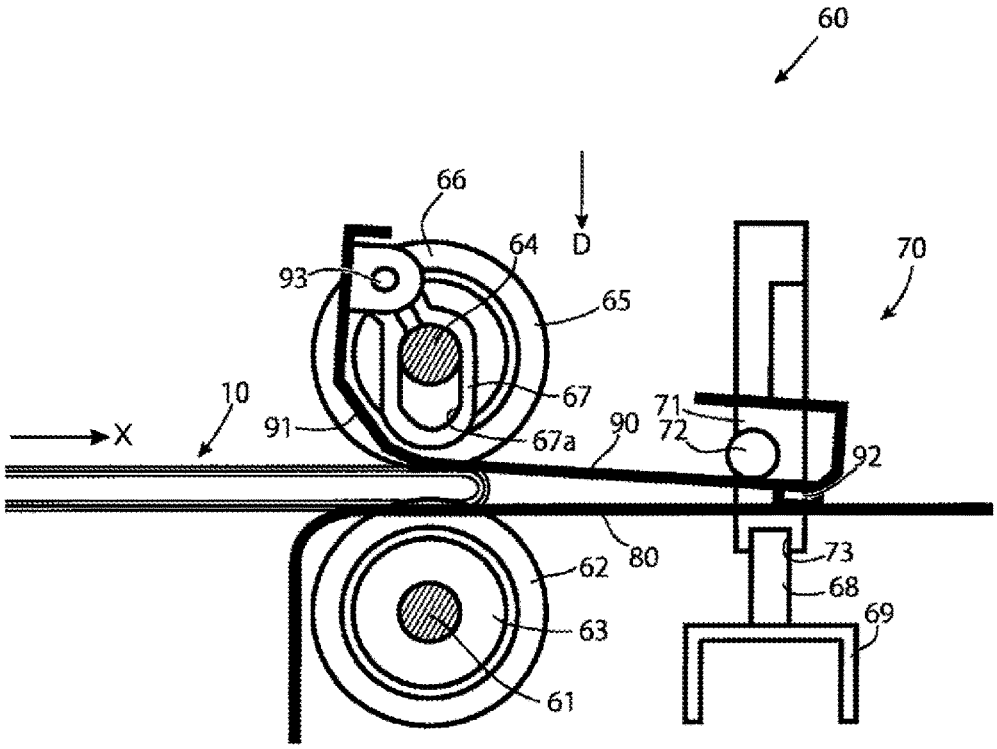
FIG. 10 is a side view of the moving unit in a state in which the booklet is transported to a position directly below the upper roller.

FIG. 10 is a side view of the moving unit 60 in a state in which the booklet 10 is transported to a position directly below the upper rollers 65.

At a timing when the booklet 10 tries to enter between the upper rollers 65 and the lower rollers 62, the upper rollers 65 descend in the direction of the arrow D and come into contact with the upper surface of the booklet 10, and the booklet 10 is sandwiched between the lower rollers 62 and the upper rollers 65 and is transported further downstream. At this time, the upstream portion of the upper chute 90 also comes into contact with the upper surface of the booklet 10, and the lower surface of the booklet 10 is in contact with the lower chute 80. In this state, the downstream portion of the upper chute 90 is still close to the lower chute 80 with a gap smaller than the thickness of the booklet 10.

Figure 11:
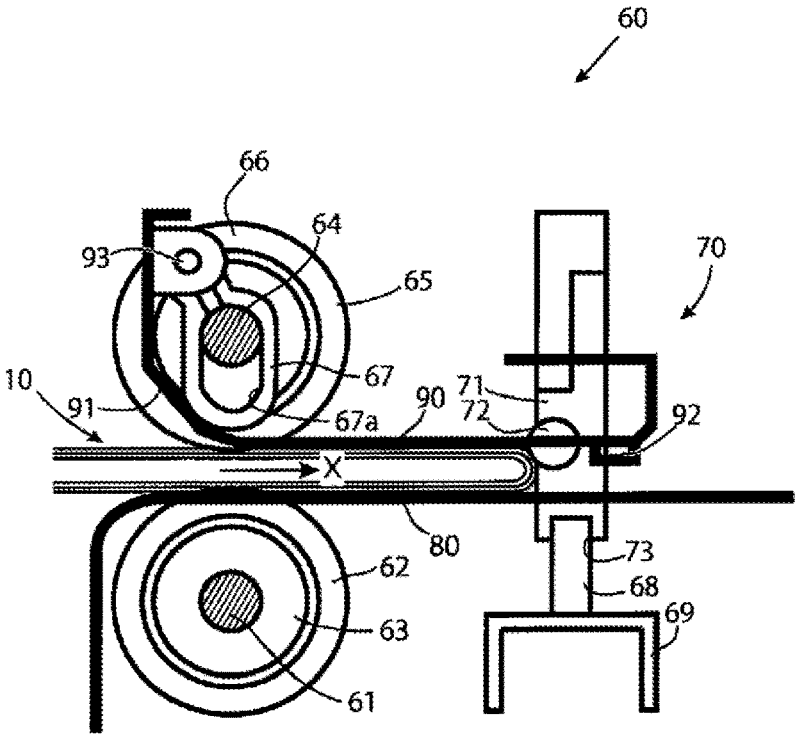
FIG. 11 is a side view of the moving unit in a state in which the booklet is further transported toward the skew correction gate.

FIG. 11 is a side view of the moving unit 60 in a state in which the booklet 10 is further transported toward the skew correction gate 70.

When the booklet 10 is fed to the downstream side by the upper rollers 65 and the lower rollers 62, the downstream portion of the upper chute 90 is lifted by the thickness of the booklet 10 accordingly. Accordingly, as illustrated in FIG. 11, the upper chute 90 is substantially parallel to the lower chute 80, the upper chute 90 comes into contact with the upper surface of the booklet 10, the lower chute 80 comes into contact with the lower surface of the booklet 10, and the booklet 10 is sandwiched between the upper chute 90 and the lower chute 80. The folded portion 11 of the booklet 10 is abutted against the abutting portion 71 of the skew correction gate 70, and the skew correction is performed.

Operations of the moving unit 60 after the skew correction are common regardless of the thickness of the booklet.

That is, when the skew correction is completed, the entire moving unit 60, that is, the entire unit including the upper rollers 65, the lower rollers 62, the upper chute 90, and the skew correction gate 70 moves in the direction of the arrow X with the booklet 10 being sandwiched. When the moving unit 60 moves to the position where the distance from the folded portion 11 of the booklet 10 in the sandwiched state to the cutter 50 (see FIG. 1) matches the predetermined dimension of the trimmed booklet, the moving unit 60 temporarily stops at the position. The cutter 50 illustrated in FIG. 1 descends, and the fore edge portion 12 of the booklet 10 is trimmed.

Thereafter, when the moving unit 60 has not reached the downstream position illustrated by the broken line in FIG. 1, the moving unit 60 starts moving again and moves to the downstream position.

Figure 12:
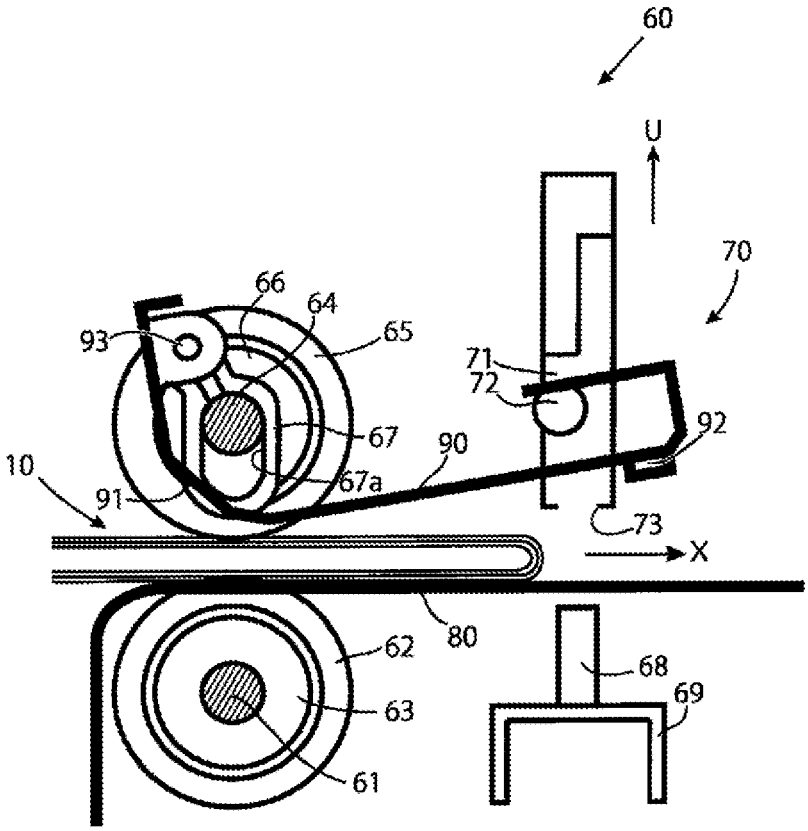
FIG. 12 is a side view of the moving unit in a state in which the skew correction gate is lifted.

FIG. 12 is a side view of the moving unit 60 in a state in which the skew correction gate is lifted.

When the moving unit 60 moves to the downstream position, the moving unit 60 stops at the downstream position and the skew correction gate 70 is lifted in the direction of the arrow U. At this time, the downstream portion of the upper chute 90 is also lifted together by the skew correction gate 70. Accordingly, a downstream path for the booklet 10 is opened. The upper rollers 65 and the lower rollers 62 rotate again, so that the booklet 10 is fed to the following stage. Thereafter, the moving unit 60 returns to the upstream position illustrated by the solid line in FIG. 1 for receiving the next booklet 10.

In this way, according to the present exemplary embodiment, no matter the booklet is thin or thick, the reliable skew correction is performed while preventing the damage to the booklet for the booklets having a wide range of thickness from a thin booklet to a thick booklet.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A trimming device comprising:

a moving unit including a roller that transports a booklet which includes one or more sheets and which is folded in half at a center portion of the booklet, with a folded portion of the booklet at a front, a skew correction gate that corrects a posture of the booklet in response to a leading end of the booklet transported by the roller abutting against the skew correction gate, the skew correction gate being capable of advancing to an abutting position on a path of the booklet and retracting from the path, and an upper guide that extends at least between the roller and the skew correction gate, the upper guide guides an upper surface of the booklet, the moving unit being movable in a transport direction between (i) a predetermined upstream position and (ii) a downstream position downstream of the upstream position in the transport direction;

a lower guide that guides a lower surface of the booklet transported by the roller; and a cutter that cuts a downstream fore edge portion of the booklet in the transport direction, the cutter being capable of advancing to the path of the booklet and retracting from the path of the booklet, wherein the upper guide is configured such that a gap between the upper guide and the lower guide widens in accordance with a thickness of the booklet to allow the booklet to pass through the gap, the roller is capable of adjusting a speed at which the booklet is transported toward the skew correction gate in at least two steps, and when a number of sheets constituting the booklet is small, the roller reduces the speed.

2. The trimming device according to claim 1, wherein the roller is capable of adjusting a pushing amount by which the roller pushes the booklet toward the skew correction gate after timing at which the folded portion of the booklet comes into contact with the skew correction gate, in at least two steps, and when the number of sheets constituting the booklet is small, the roller reduces the pushing amount.

3. The trimming device according to claim 2, wherein the roller includes a lower roller that comes into contact with the lower surface of the booklet, and an upper roller that comes into contact with the upper surface of the booklet, the upper roller being capable of moving up and down, and an upstream portion of the upper guide at the upstream position is supported by the upper roller and moves up and down as the upper roller moves up and down.

4. The trimming device according to claim 3, wherein the upper roller includes a rotation shaft, and a bearing including an elongating slot into which the rotation shaft is inserted, and the upstream portion is supported by the bearing.

5. The trimming device according to claim 2, wherein the upper guide or the lower guide includes a boss that defines a minimum interval between the lower guide and the upper guide.

6. The trimming device according to claim 1, wherein the roller includes a lower roller that comes into contact with the lower surface of the booklet, and an upper roller that comes into contact with the upper surface of the booklet, the upper roller being capable of moving up and down, and an upstream portion of the upper guide at the upstream position is supported by the upper roller and moves up and down as the upper roller moves up and down.

7. The trimming device according to claim 6, wherein the upper roller includes a rotation shaft, and a bearing including an elongating slot into which the rotation shaft is inserted, and the upstream portion is supported by the bearing.

8. The trimming device according to claim 6, wherein the upper guide or the lower guide includes a boss that defines a minimum interval between the lower guide and the upper guide.

9. The trimming device according to claim 1, wherein the upper guide or the lower guide includes a boss that defines a minimum interval between the lower guide and the upper guide.

10. The trimming device according to claim 9, wherein the skew correction gate moves upward to retract from the path, and in moving upward, the skew correction gate hooks the upper guide to lift a downstream portion of the upper guide.

11. The trimming device according to claim 1, wherein the skew correction gate includes a pair of abutting portions at two positions separated from each other in a width direction intersecting the transport direction of the booklet, two parts of the folded portion of the booklet which are separated from each other in the width direction abutting against the abutting portions.

12. The trimming device according to claim 11, wherein the roller includes two sets of transport rollers, each set being at a respective one of the two positions separated from each other in the width direction which intersects the transport direction of the booklet, the two sets of transport rollers sandwiching the booklet from above and below.

13. The trimming device according to claim 12, wherein when viewed from the transport direction of the booklet, each of the abutting portions and a respective one of the transport rollers at least partially overlap each other.

14. The trimming device according to claim 12, wherein the roller includes torque limiters that act on the two sets of transport rollers independently.

15. A post-processing device comprising:

a booklet manufacturing device that receives sequentially transported sheets, manufactures a booklet which includes one or more sheets and which is folded in half in a center portion of the booklet, and feeds the booklet with a folded portion of the booklet at a front; and the trimming device according to claim 1 that receives the booklet fed from the booklet manufacturing device and trims the downstream fore edge portion of the booklet in the transport direction.

16. An image forming apparatus with a post-processing device, comprising:

the post-processing device according to claim 15; and an image forming device that forms images on the sheets and transports the sheets on which the images are formed toward the post-processing device.

17. A trimming device comprising:

a moving unit including a roller that transports a booklet which includes one or more sheets and which is folded in half at a center portion of the booklet, with a folded portion of the booklet at a front, a skew correction gate that corrects a posture of the booklet in response to a leading end of the booklet transported by the roller abutting against the skew correction gate, the skew correction gate being capable of advancing to an abutting position on a path of the booklet and retracting from the path, and an upper guide that extends at least between the roller and the skew correction gate, the upper guide guides an upper surface of the booklet, the moving unit being movable in a transport direction between (i) a predetermined upstream position and (ii) a downstream position downstream of the upstream position in the transport direction;

a lower guide that guides a lower surface of the booklet transported by the roller; and a cutter that cuts a downstream fore edge portion of the booklet in the transport direction, the cutter being capable of advancing to the path of the booklet and retracting from the path of the booklet, wherein the upper guide is configured such that a gap between the upper guide and the lower guide widens in accordance with a thickness of the booklet to allow the booklet to pass through the gap, the roller includes a lower roller that comes into contact with the lower surface of the booklet, and an upper roller that comes into contact with the upper surface of the booklet, the upper roller being capable of moving up and down, and an upstream portion of the upper guide at the upstream position is supported by the upper roller and moves up and down as the upper roller moves up and down, and the upper roller includes a rotation shaft, and a bearing including an elongating slot into which the rotation shaft is inserted, and the upstream portion is supported by the bearing.

18. A trimming device comprising:

a moving unit including a roller that transports a booklet which includes one or more sheets and which is folded in half at a center portion of the booklet, with a folded portion of the booklet at a front, a skew correction gate that corrects a posture of the booklet in response to a leading end of the booklet transported by the roller abutting against the skew correction gate, the skew correction gate being capable of advancing to an abutting position on a path of the booklet and retracting from the path, and an upper guide that extends at least between the roller and the skew correction gate, the upper guide guides an upper surface of the booklet, the moving unit being movable in a transport direction between (i) a predetermined upstream position and (ii) a downstream position downstream of the upstream position in the transport direction;

a lower guide that guides a lower surface of the booklet transported by the roller; and a cutter that cuts a downstream fore edge portion of the booklet in the transport direction, the cutter being capable of advancing to the path of the booklet and retracting from the path of the booklet, wherein the upper guide is configured such that a gap between the upper guide and the lower guide widens in accordance with a thickness of the booklet to allow the booklet to pass through the gap, the upper guide or the lower guide includes a boss that defines a minimum interval between the lower guide and the upper guide, the skew correction gate moves upward to retract from the path, and in moving upward, the skew correction gate hooks the upper guide to lift a downstream portion of the upper guide.

* * * * *